US012331950B2

(12) United States Patent
Hunt et al.

(10) Patent No.: US 12,331,950 B2
(45) Date of Patent: Jun. 17, 2025

(54) HVAC SENSOR INFORMATION AND SENSOR COMMUNICATION OVER RELAY-CONTROLLED POWER LINE

(71) Applicant: Carrier Corporation, Palm Beach Gardens, FL (US)

(72) Inventors: Gerald P. Hunt, Fishers, IN (US); Ron Kielkowski, Indianapolis, IN (US); Eric Slone, New Palestine, IN (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 373 days.

(21) Appl. No.: 17/861,639

(22) Filed: Jul. 11, 2022

(65) Prior Publication Data

US 2023/0029182 A1 Jan. 26, 2023

Related U.S. Application Data

(60) Provisional application No. 63/221,095, filed on Jul. 13, 2021.

(51) Int. Cl.
*F24F 11/54* (2018.01)
*F24F 11/66* (2018.01)

(52) U.S. Cl.
CPC ..... *F24F 11/66* (2018.01); *F24F 11/54* (2018.01)

(58) Field of Classification Search
CPC ..... F24F 11/54
See application file for complete search history.

(56) References Cited

U.S. PATENT DOCUMENTS

| | | | |
|---|---|---|---|
| 4,034,570 | A | 7/1977 | Anderson et al. |
| 4,526,010 | A | 7/1985 | Sato et al. |
| 6,956,463 | B2 | 10/2005 | Crenella et al. |
| 7,244,294 | B2 | 7/2007 | Kates |
| 7,379,997 | B2 | 5/2008 | Ehlers et al. |
| 7,775,452 | B2 | 8/2010 | Shah et al. |
| 10,156,378 | B2 | 12/2018 | Alsaleem |
| 10,267,532 | B2 | 4/2019 | Kadah et al. |
| 10,309,672 | B2 | 6/2019 | Filson et al. |
| 10,533,768 | B2 | 1/2020 | Mowris et al. |

(Continued)

FOREIGN PATENT DOCUMENTS

| | | | | |
|---|---|---|---|---|
| DE | 102006049402 | A1 * | 4/2008 | ..... H04B 3/54 |
| KR | 100751834 | B1 | 8/2007 | |

(Continued)

*Primary Examiner* — Suresh Suryawanshi
(74) *Attorney, Agent, or Firm* — CANTOR COLBURN LLP

(57) ABSTRACT

Provided are embodiments for a heating, ventilation, and air conditioning (HVAC) system for providing sensor information and sensor communication over relay-controlled power line. The system can include a controller of the HVAC system and a first power line converter coupled to the controller. The first power line converter is configured to receive data over a serial bus, convert the data into a communication message for transmission onto a power line, wherein the power line is configured to transmit power and communication messages, and transmit the communication message over the power line. Also provided are embodiments for transmitting and receiving a communication message over relay-controlled power line.

16 Claims, 3 Drawing Sheets

(56) References Cited

U.S. PATENT DOCUMENTS

| | | | | |
|---|---|---|---|---|
| 2005/0090915 | A1* | 4/2005 | Geiwitz | G05B 15/02 700/275 |
| 2006/0174102 | A1* | 8/2006 | Smith | H04W 12/0471 713/150 |
| 2009/0013703 | A1* | 1/2009 | Werner | F24F 5/0046 62/180 |
| 2012/0010833 | A1* | 1/2012 | Alro | H02J 3/14 702/62 |
| 2013/0293155 | A1* | 11/2013 | Campbell | H05B 47/10 315/307 |
| 2018/0048309 | A1* | 2/2018 | Vogt, IV | H04B 3/548 |
| 2019/0353368 | A1* | 11/2019 | Gillette | G05B 15/02 |
| 2020/0059081 | A1 | 2/2020 | Freeman et al. | |
| 2020/0386434 | A1 | 12/2020 | Blair | |
| 2021/0025615 | A1 | 1/2021 | Heigl | |
| 2021/0095876 | A1 | 4/2021 | Branson et al. | |

FOREIGN PATENT DOCUMENTS

| | | | |
|---|---|---|---|
| KR | 101063532 | B1 | 9/2011 |
| WO | 2020194658 | A1 | 10/2020 |

* cited by examiner

HVAC SENSOR INFORMATION AND SENSOR COMMUNICATION OVER RELAY-CONTROLLED POWER LINE

CROSS-REFERENCE TO RELATED APPLICATIONS

This application claims the benefit of Provisional Application No. 63/221,095 filed Jul. 13, 2021, the disclosure of which is incorporated herein by reference in its entirety.

BACKGROUND

The present disclosure relates to heating, ventilation, and air condition (HVAC) network communications, and more specifically, to HVAC sensor information and sensor communication over relay-controlled power line.

HVAC components often need to communicate, for example, to provide control and analysis of the HVAC system. Existing HVAC systems employ separate power lines and communication lines to provide communication and power between the HVAC components. There may be a need to leverage the existing wiring to reduce the complexity of HVAC systems that do not conventionally carry digital information.

BRIEF DESCRIPTION

According to an embodiment, a heating, ventilation, and air conditioning (HVAC) system for providing sensor information and sensor communication over relay-controlled power line is provided. The system includes a controller of the HVAC system, and a first power line converter coupled to the controller. The first power line converter is configured to receive data over a serial bus; convert the data into a communication message for transmission onto a power line, wherein the power line is configured to transmit power and communication messages; and transmit the communication message over the power line.

In addition to one or more of the features described herein, or as an alternative, further embodiments include using a sensor controller that is coupled to the power line and to one or more sensors, wherein the sensor controller is configured to obtain sensor data from the one or more sensors.

In addition to one or more of the features described herein, or as an alternative, further embodiments include using a sensor controller that is coupled to a second power line converter, wherein the sensor controller is configured to provide the sensor data to the second power line converter.

In addition to one or more of the features described herein, or as an alternative, further embodiments include using a second power line converter that is configured to convert the sensor data from the one or sensors for transmission over the power line.

In addition to one or more of the features described herein, or as an alternative, further embodiments include using a sensor controller that is operated in at least one of a sleep mode or a normal mode, wherein when operating in the sleep mode the sensor controller is not processing sensor data and wherein when operating in the normal mode the sensor controller processes the sensor data.

In addition to one or more of the features described herein, or as an alternative, further embodiments include using a sensor controller that receives power from the power line when operated in the normal mode.

In addition to one or more of the features described herein, or as an alternative, further embodiments include using a sensor controller that supplies power to the second power line converter.

In addition to one or more of the features described herein, or as an alternative, further embodiments include using a first power line converter that receives power from the controller.

In addition to one or more of the features described herein, or as an alternative, further embodiments include using a first power line converter that exchanges data with the controller over a serial bus.

In addition to one or more of the features described herein, or as an alternative, further embodiments include using a second power line converter that exchanges data with the sensor controller over a serial bus.

According to an embodiment, a method for transmitting a communication message over relay-controlled power line is provided. The method includes receiving serial data from a controller; converting the serial data to a communication message for transmission over a power line, wherein the power line is configured to transmit power and communication messages; and transmitting the communication message over the power line.

In addition to one or more of the features described herein, or as an alternative, further embodiments include receiving, at the first power line converter, power from the controller.

In addition to one or more of the features described herein, or as an alternative, further embodiments include using a power line that provides power to an outdoor unit and a sensor controller.

In addition to one or more of the features described herein, or as an alternative, further embodiments include using a sensor controller that is operated in at least one of a sleep mode or a normal mode, wherein when operating in the sleep mode the sensor controller is not processing sensor data, and wherein when operating in the normal mode the sensor controller processes the sensor data.

According to an embodiment, a method receiving a communication message from a relay-controlled power line is provided. The method includes receiving a communication message over a power line; converting the communication message to serial data from the power line, wherein the power line is configured to transmit power and communication messages; and transmitting the serial data to the controller over a serial bus.

In addition to one or more of the features described herein, or as an alternative, further embodiments include using a serial bus that is received by a universal asynchronous receiver/transmitter (UART).

In addition to one or more of the features described herein, or as an alternative, further embodiments include using a communication message that includes data corresponding to sensor data from one or more sensors of a heating, ventilation, and air conditioning (HVAC) system.

In addition to one or more of the features described herein, or as an alternative, further embodiments include receiving the communication message from a second power line converter.

In addition to one or more of the features described herein, or as an alternative, further embodiments include using a second power line converter that is powered from a sensor controller.

In addition to one or more of the features described herein, or as an alternative, further embodiments include using a sensor controller that is operated in at least one of a sleep mode or a normal mode, wherein when operating in the sleep mode the sensor controller is not processing sensor data and wherein when operating in the normal mode the sensor controller processes the sensor data.

Technical effects of embodiments of the present disclosure include enhancing the capability of less complex equipment to incorporate communication capability for remote monitoring functions.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
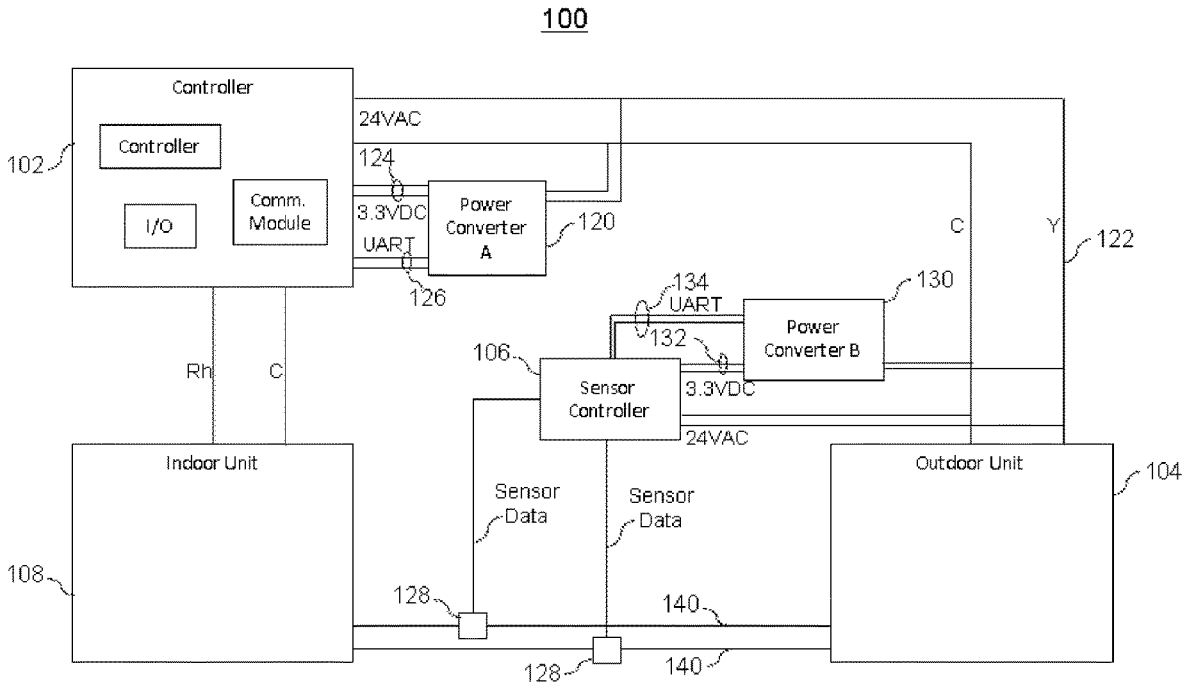
FIG. 1 depicts a schematic block diagram of a system for providing sensor information and sensor communication over relay-controlled power line in accordance with one or more embodiments of the disclosure.

FIG. 1 depicts a schematic block diagram of a HVAC system 100 for providing sensor information and sensor communication over relay-controlled power line. FIG. 1 depicts multiple HVAC components in communication over an HVAC network in an example embodiment. A first component 102 includes a controller, a communications module and an I/O unit. In an example embodiment, the first component 102 is a thermostat of an HVAC system 100. The controller may include a processor (not shown) and an associated memory (not shown). The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be, but is not limited to, a random access memory (RAM), read only memory (ROM), or other electronic, optical, magnetic or any other computer readable medium. The memory may store executable instructions, that when executed by the processor, cause the controller 102 to perform operations described herein.

The communications module provides enhanced communications between the first component 102 and one or more further components such as a second component 104 (which may be an outdoor unit), a third component 106 (which may be a sensor controller), and a fourth component 108 (which may be an indoor unit), as described herein. In a non-limiting example, the outdoor units can include heat pumps, air conditioning systems, geothermal units, etc. The indoor units can include various equipment for hydronic heat, electric heat, furnace, heat from a heat pump and cooling from a heat pump or air conditioner. Additional functions of the indoor units can include but is not limited to air filtration, air ventilation, humidification, and/or dehumidification. Although FIG. 1 depicts a limited number of components, it should be understood that the communications techniques described herein may apply to any number of components coupled to the HVAC system 100. For example, in some scenarios the outdoor unit may not be required for operation in the system 100. In one or more embodiments of the disclosure, the power line converter A 120 is configured to convert data into a communication message that can be transmitted over the AC power line 122. In one or more embodiments of the disclosure, the power line converter A 120 must be powered up prior to generating the communication message. The techniques described herein enable communication message to be transmitted over the power line 122 and is not required to be transmitted over a separate cable/line. The power line converter A 120 can also be configured to detect or "listen" for the communication messages that are transmitted over the AC power line 122 and convert the detected messages into signals that can be processed by the controller of the first component 102.

In one or more embodiments of the disclosure, the power line converter A 120 can be integrated into the first component 102 to enable the communication over the power line 122. The power line converter A 120 is powered from the first component 102 over a DC connection 124, and the power line converter A 120 is configured to exchange data with the first component 102 over a serial bus such as the UART 126. For example, the power line converter A 120 is powered by 3.3V DC and communicates over the power line 122 In some embodiments, the power line converter A 120 can be integrated within the first component 102.

In one or more embodiments of the disclosure, power for the outdoor unit (component 104) can be received from a separate high-voltage source (not shown). The outdoor unit can include but is not limited to a compressor, condenser, fan, etc. The signal that is received at the outdoor unit from the power line 122 is a low-voltage signal that can be used to close a contactor of the outdoor unit that allows it to be powered on. In some embodiments, components 106 and 130 can be arranged on single board (not shown). In such embodiments, the single board is enabled to convert the 24 v AC from the power line 122 to 3.3 v DC to provide power to both component 106 and component 130.

In some embodiments, a third component 106, the sensor controller, can receive AC power supplied from the first component 102 over the power line 122 for operation. The sensor controller can be coupled to one or more sensors 128. The sensor controller can provide power to the sensors 128 by converting the AC power from the power line to a form that is compatible with the operation of the sensors 128.

In some embodiments, the low-voltage signal from the power line 122 can be used to power the sensor controller (component 106). In other embodiments, the sensors 128 can be powered by a different power source (not shown). As shown in FIG. 1, the sensors 128 can be arranged on the refrigeration lines 140 and are configured to monitor a condition of the refrigeration lines 140. Alternatively, sensors 128 can be used for monitoring compressor power and outdoor temperature.

Responsive to the sensors 128 sensing the refrigeration lines (temperature, pressure, etc.) the sensor data is transmitted to and is obtained by the sensor controller 106. The sensor controller is configured to convert the sensor data and transmit the converted sensor data to the power line converter B 130.

Similar to the power line converter A 120, the power line converter B 130 is configured to convert the received data into a format for transmitting the communication message over the power line 122 to the first component 102, the thermostat. In a non-limiting example, the sensor controller draws the 24V AC from the power line 122 or from the board (not shown) and converts the power to 3.3V DC to supply power to the power line converter B 130 for operation. Also, the power line converter B 130 communicates with the sensor controller over a serial bus using the UART 134.

In one or more embodiments of the disclosure, the sensor controller can operate in a sleep mode. In the sleep mode, the sensor controller is not processing the sensor data from the one or more sensors. In some embodiments, no power can be provided during the sleep mode. In other embodiments, the power can be available in the sleep mode in an intermittent or a continuous fashion. The sensor controller can be switched from the sleep mode and operated in the normal mode. During the normal mode, the sensor controller is obtaining the sensor data from the sensors and processing the sensor data.

In one or more embodiments of the disclosure, the sensors 128 and the sensor controller are powered over the same line that is used for communication of the sensor data. The line power is relay controlled by the thermostat so that the sensor and the sensor controller only sample data and report on the data while the line is activated. The HVAC system can use the Y (outdoor activation) line and the C (Common) line for both power and communications. When the thermostat activates the relay Y on the 24 VAC lines, the sensor controller wakes up, powers power line converter B 130, and starts reading the data from the sensors 128 that are coupled to the sensor controller.

The sensor controller can convert the sensor data from the one or more sensors 128 to a format suitable for the power line converter B 130 and provide the converted data to the power line converter B 130 over the UART 134. The power line converter B 130 is configured to further convert the received data for transmission over the power line 122 and transmit the converted communication message over the power line 122 to the first component 102. The communication message is received by the power line converter A 120 and converts the communication message into a format that can be processed by the controller of the first component 102. Based on the message the first component 102 to control the other components of the HVAC system and send power and control signals over power line 122. In some embodiments, the thermostat receives the data from the UART and processes the data. The Y line can be routed through the Indoor Unit then on to the Outdoor Unit.

In one or more embodiments of the disclosure, the first component 102, the thermostat, can be supplied power from the fourth component 108, an indoor unit, over the connection Rh. Also, the first component 102 and the fourth component 108 can be coupled over a common connection C. The indoor unit can provide the source of power for the HVAC system 100. In a non-limiting example, the indoor unit can include equipment such as but not limited to an evaporator, blower fan, etc.

In some embodiments, an indoor unit may be included in the system 100 and the outdoor unit may not be included in the system 100. In such embodiments, sensors 128 can also be used to monitor the indoor unit. In other embodiments, the "Y" line may be used to transmit sensor data about the indoor unit. In such embodiments, 3 power converters may be included in the system 100.

Figure 2:
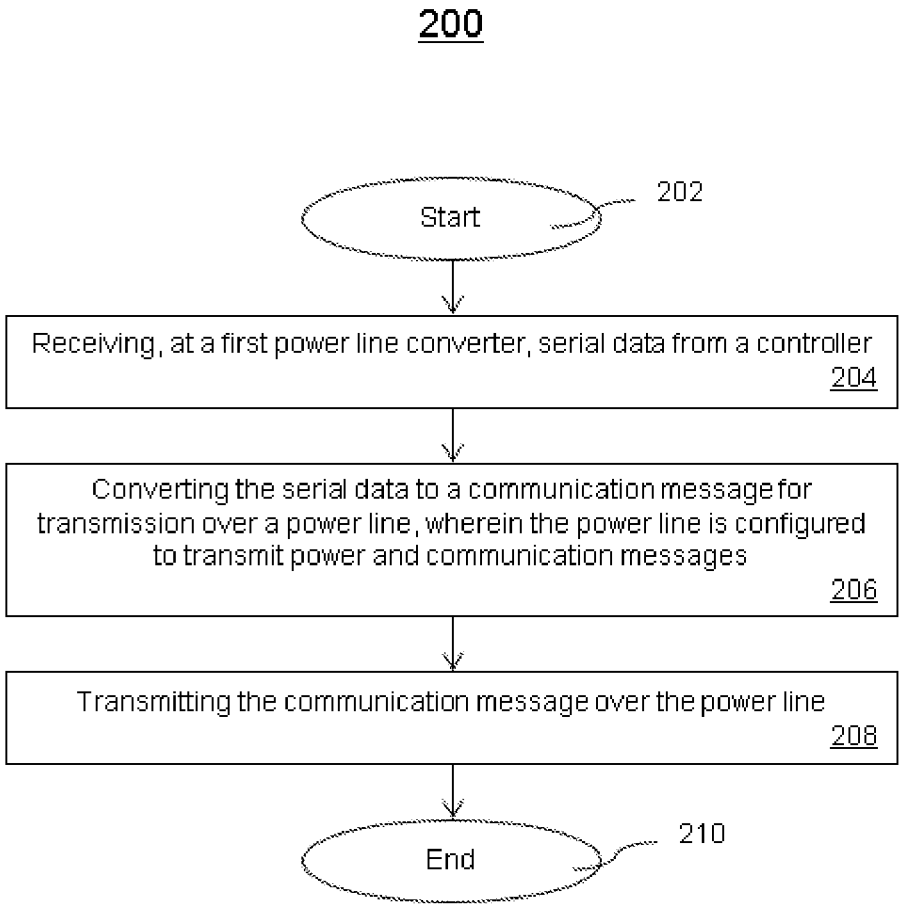
FIG. 2 depicts a flowchart of a method for providing HVAC sensor information and sensor communication over relay-controlled power line in accordance with one or more embodiments of the disclosure.

FIG. 2 depicts a flowchart of a method 200 for transmitting a communication message over relay-controlled power line in accordance with one or more embodiments of the disclosure. In one or more embodiments of the disclosure, the method 200 can be performed in a system such as that shown with reference to FIG. 1. The method 200 begins at block 202 and proceeds to block 204 which provides for receiving serial data from a controller. In one or more embodiments of the disclosure, data such as sensor data or communication data can be received at a sensor controller where the sensor controller converts the data into serial data for processing at a power line converter. The sensor data can include data such as temperature data, pressure data, humidity data, etc. Block 206 converts the serial data to a communication message for transmission over a power line, wherein the power line is configured to transmit power and communication messages. Block 208 transmits the communication message over the power line. The method 200 ends at block 210.

One or more illustrative embodiments of the disclosure are described herein. Such embodiments are merely illustrative of the scope of this disclosure and are not intended to be limiting in any way. Accordingly, variations, modifications, and equivalents of embodiments disclosed herein are also within the scope of this disclosure.

Figure 3:
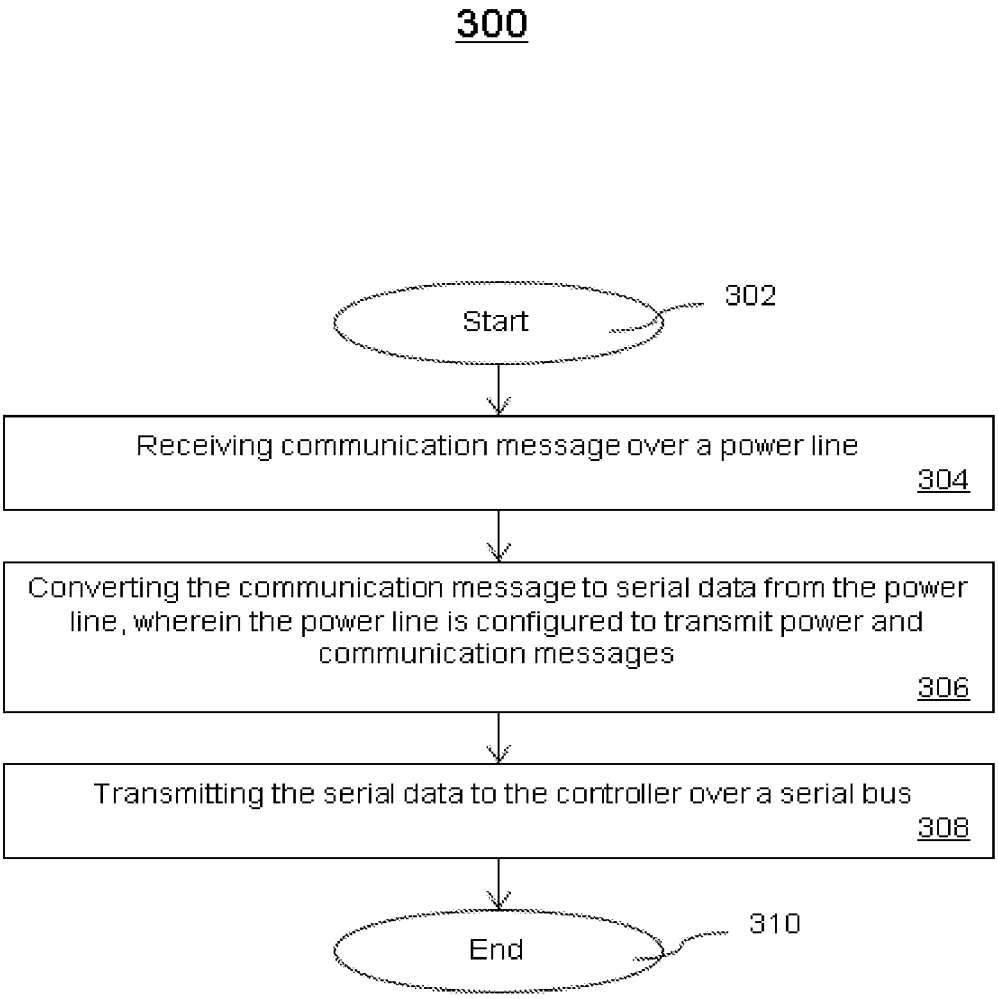
FIG. 3 depicts a flowchart of a method for providing HVAC sensor information and sensor communication over relay-controlled power line in accordance with one or more embodiments of the disclosure.

FIG. 3 depicts a flowchart of a method 300 for receiving a communication message over power line in accordance with one or more embodiments of the disclosure. The method 300 begins at block 302 and proceeds to block 304 which provides for receiving a communication message over a power line. The communication messages correspond to sensor data obtained from one or more sensors coupled to the HVAC system 100. Block 306 converts the communication message to serial data from the power line, wherein the power line is configured to transmit power and communication messages. The communication message can be received at a first power line converter where the communication message is provided from a second power line converter that is coupled to the power line. The first power line converter converts the communication message to serial data which is processed by a processor of the controller. Block 308 transmits the serial data to the controller over a serial bus. The serial data can be transmitted to the controller using a UART. The sensor data from the serial data can be obtained by the controller and used to control the indoor unit and/or outdoor unit according to the sensor data. The method 300 ends a block 310.

One or more illustrative embodiments of the disclosure are described herein. Such embodiments are merely illustrative of the scope of this disclosure and are not intended to be limiting in any way. Accordingly, variations, modifications, and equivalents of embodiments disclosed herein are also within the scope of this disclosure.

The technical benefits and effects include enabling less complex equipment that do not include means for wired communication to exchange communication messages over power line. The techniques described herein leverage the existing power lines for transmission of both communication information and power with limited modification, thus giving the capability of remote monitoring to the less complex systems.

A detailed description of one or more embodiments of the disclosed apparatus and method are presented herein by way of exemplification and not limitation with reference to the Figures.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A heating, ventilation, and air conditioning (HVAC) system for providing sensor information and sensor communication over relay-controlled power line, the system comprising:

a controller of the HVAC system;

a first power line converter coupled to the controller, wherein the first power line converter is configured to: receive data over a serial bus;

convert the data into a communication message for transmission onto a power line, wherein the power line is configured to transmit power and communication messages; and transmit the communication message over the power line;

a sensor controller coupled to the power line and to one or more sensors, wherein the sensor controller is configured to obtain sensor data from the one or more sensors;

wherein the sensor controller is coupled to a second power line converter coupled to the power line, wherein the sensor controller is configured to provide the sensor data to the second power line converter.

2. The system of claim 1, wherein the second power line converter is configured to convert the sensor data from the one or sensors for transmission over the power line.

3. The system of claim 1, wherein the sensor controller is operated in at least one of a sleep mode or a normal mode, wherein when operating in the sleep mode the sensor controller is not processing sensor data and wherein when operating in the normal mode the sensor controller processes the sensor data.

4. The system of claim 1, wherein the sensor controller receives power from the power line when operated in the normal mode.

5. The system of claim 4, wherein the sensor controller supplies power to the second power line converter.

6. The system of claim 1, wherein the first power line converter receives power from the controller.

7. The system of claim 1, wherein the first power line converter exchanges data with the controller over a serial bus.

8. The system of claim 1, wherein the second power line converter exchanges data with the sensor controller over a serial bus.

9. A method for transmitting a communication message over relay-controlled power line, the method comprising:

receiving, at a first power line converter, serial data from a controller;

converting the serial data to a communication message for transmission over a power line, wherein the power line is configured to transmit power and communication messages;

transmitting the communication message over the power line;

obtaining, at a sensor controller coupled to the power line and to one or more sensors, sensor data from the one or more sensors;

providing, by the sensor controller, the sensor data to a second power line converter coupled to the power line.

10. The method of claim 9, further comprising receiving, at the first power line converter, power from the controller.

11. The method of claim 9, wherein the power line provides power to an outdoor unit and a sensor controller.

12. The method of claim 11, wherein the sensor controller is operated in at least one of a sleep mode or a normal mode, wherein when operating in the sleep mode the sensor controller is not processing sensor data, and wherein when operating in the normal mode the sensor controller processes the sensor data.

13. A method for receiving a communication message from a relay-controlled power line, the method comprising:

receiving, at a first power line converter, a communication message over a power line;

converting the communication message to serial data from the power line, wherein the power line is configured to transmit power and communication messages; and transmitting the serial data to the controller over a serial bus;

wherein the communication message includes data corresponding to sensor data from one or more sensors of a heating, ventilation, and air conditioning (HVAC) system;

wherein the sensor data is received at a sensor controller and provided to a second power line converter;

wherein receiving the communication message comprises receiving the communication message from the second power line converter.

14. The method of claim 13, wherein the serial bus is received by a universal asynchronous receiver/transmitter (UART).

15. The method of claim 13, wherein the second power line converter is powered from the sensor controller.

16. The method of claim 15, wherein the sensor controller is operated in at least one of a sleep mode or a normal mode, wherein when operating in the sleep mode the sensor controller is not processing sensor data and wherein when operating in the normal mode the sensor controller processes the sensor data.

* * * * *